US009545164B2

(12) United States Patent
Tulloch

(10) Patent No.: US 9,545,164 B2
(45) Date of Patent: Jan. 17, 2017

(54) SYSTEM FOR SECURING A MATTRESS COVER

(71) Applicant: Symone Tulloch, Coral Springs, FL (US)

(72) Inventor: Symone Tulloch, Coral Springs, FL (US)

( * ) Notice: Subject to any disclaimer, the term of this patent is extended or adjusted under 35 U.S.C. 154(b) by 20 days.

(21) Appl. No.: 13/770,658

(22) Filed: Feb. 19, 2013

(65) Prior Publication Data

US 2014/0150181 A1 Jun. 5, 2014

Related U.S. Application Data

(60) Provisional application No. 61/600,850, filed on Feb. 20, 2012.

(51) Int. Cl.
*A47G 9/02* (2006.01)
*A47C 21/02* (2006.01)
*A47G 9/04* (2006.01)

(52) U.S. Cl.
CPC ..... *A47G 9/0238* (2013.01); *A47C 21/02* (2013.01); *A47C 21/022* (2013.01); *A47C 21/028* (2013.01); *A47G 9/02* (2013.01); *A47G 9/0246* (2013.01); *A47G 9/0292* (2013.01); *A47G 9/04* (2013.01)

(58) Field of Classification Search
CPC ..... A47C 21/00; A47C 21/02; A47C 21/022; A47C 21/026; A47C 21/028; A47G 2009/00; A47G 9/02; A47G 9/0238; A47G 9/0246; A47G 9/0284; A47G 9/0292; A47G 9/04
USPC ..... 5/490, 491, 493, 501
See application file for complete search history.

(56) References Cited

U.S. PATENT DOCUMENTS 2,024,050 A * 12/1935 May ..... A47C 21/022 24/72.5
3,736,604 A * 6/1973 Carson, Jr. ..... 5/422
3,858,256 A * 1/1975 Beer ..... A47G 9/0246 297/225
4,141,097 A * 2/1979 Levinsohn ..... A47G 9/0292 5/493
4,411,034 A * 10/1983 Williams ..... 5/494
4,970,744 A * 11/1990 Davis ..... A47G 9/0246 5/496
5,046,207 A * 9/1991 Chamberlain ..... A47G 9/0246 5/496
5,134,736 A * 8/1992 Anthony ..... A47C 21/022 5/496
5,173,976 A 12/1992 Jubinville
5,325,554 A * 7/1994 Lewis ..... A47C 21/022 5/496

(Continued)

FOREIGN PATENT DOCUMENTS

CA 2228414 A1 * 6/1999 ..... A47C 21/022

*Primary Examiner* — Nicholas Polito
*Assistant Examiner* — David R Hare
(74) *Attorney, Agent, or Firm* — Allen F. Bennett; Bennett Intellectual Property

(57) ABSTRACT

A mattress cover includes a securing belt about its skirt to aid in engaging and fixing the skirt to a mattress, thereby minimizing the tendency of a skirt to migrate upward on the mattress during use. The belt may be attached to the skirt by means of a sleeve extending the length of the skirt, lacing, belt loop structures, an integrated channel, Velcro® or similar devices. The belt may be adjusted by means of a buckle, a knot or other similar devices.

5 Claims, 4 Drawing Sheets

(56) References Cited

U.S. PATENT DOCUMENTS 5,327,595 A * 7/1994 Allen ..... A47C 21/022 24/72.5
5,557,814 A * 9/1996 Cybulski ..... A47G 9/0246 5/485
5,802,637 A * 9/1998 Bordo ..... A47C 31/11 297/219.11
6,035,469 A * 3/2000 Schrougham ..... A47G 9/0292 5/493
6,161,235 A 12/2000 Smith et al.
6,854,139 B2 * 2/2005 Lamy ..... A47G 9/02 5/482
7,093,310 B2 * 8/2006 Barros ..... A47G 9/0292 5/482
7,168,113 B1 * 1/2007 Olsen ..... A47G 9/0284 5/482
7,316,039 B2 1/2008 Wootten, Jr.
7,398,570 B2 * 7/2008 Seago ..... A47G 9/0246 5/497
7,810,184 B2 10/2010 McCollum
2002/0116763 A1 * 8/2002 Weir ..... A47G 9/0246 5/504.1
2003/0019037 A1 * 1/2003 Michaelis ..... A47G 9/02 5/497
2004/0064889 A1 * 4/2004 Diak/Ghanem ..... A47G 9/02 5/482
2008/0028522 A1 * 2/2008 Atwood ..... A47G 9/0246 5/496
2009/0172881 A1 * 7/2009 Peterson ..... A47C 21/022 5/496
2010/0154125 A1 * 6/2010 Fratovich ..... 5/691
2012/0227183 A1 * 9/2012 Muskelly ..... 5/487
2012/0297541 A1 * 11/2012 Brown ..... 5/490
2013/0254990 A1 * 10/2013 Kim ..... A47G 9/0246 5/497
2014/0013510 A1 * 1/2014 Mcaleney ..... A47G 9/0246 5/496
2014/0130262 A1 * 5/2014 Marcik ..... A47C 21/022 5/692
2015/0040316 A1 * 2/2015 Graves ..... A47G 9/0292 5/493
2016/0007774 A1 * 1/2016 Kakabeeke ..... A47G 9/0246 5/496

* cited by examiner

SYSTEM FOR SECURING A MATTRESS COVER

CROSS-REFERENCE TO RELATED APPLICATIONS

This application claims priority to U.S. Provisional Application Ser. No. 61/600,850, filed Feb. 20, 2012, the contents of which are hereby incorporated by reference in their entirety.

FIELD OF THE INVENTION

The present invention relates to mattress covers and, more particularly, to a mattress cover capable of accommodating mattresses having a variety of different thicknesses or depths. Still more particularly, the present invention is directed to a mattress cover which will fit securely on mattresses of various thicknesses without migrating upward and off.

BACKGROUND

Mattresses today are available in a wide variety of sizes and styles. Among the most popular sizes are twin, queen and king. Although the mattresses in each of these size groups have more or less the same nominal length and width dimensions, the thickness or depth dimension of the mattresses often differs substantially among mattresses within the same size group based upon such factors as the construction of the mattresses, their style, the amount of padding, etc.

In view of the large range of thicknesses in which mattresses are available, it is difficult to make a mattress cover which will fit snugly on all of the mattresses within a given size group. For example, a conventional mattress cover, also known as a bed sheet or fitted sheet, typically includes top panel, a skirt extending from the periphery of the top panel and an elastic band along the lower edge of the skirt intended to fit under the mattress to hold the mattress cover in place. Mattress covers of this type typically fit poorly on thin mattresses so that, even with extensive tucking, such mattress covers sag, wrinkle and hang loosely when in use, such that the mattress cover often slips relative to the mattress. At the other extreme, these conventional mattress covers frequently will have a skirt portion which is not sufficiently deep to reach below mattresses which are relatively thick, and therefore will frequently slip off of these mattresses.

To address the foregoing problems, a wide array of systems have been developed for securely holding mattress covers to mattresses within a wide range of thicknesses, as shown, for example in U.S. Pat. No. 5,249,322 to Seago and U.S. Pat. No. 5,479,664 to Hollander. These systems have met with little success, often introducing problems which did not exist with conventional mattress covers. For example, one device includes elastic anchor bands attached diagonally across each corner of the panel for engaging below the corners of the mattress. These mattress covers do not engage the mattress securely, and the anchor bands tend to disengage the mattress easily. As a result, the skirt migrates upward while in use to the point that it no longer engages the sides of the mattress and no longer effectively covers the mattress. This is particularly inconvenient when a person is sleeping on the mattress.

A further drawback to prior art mattress covers has been that the placement of discernible indicia on the mattress covers has been visually objectionable. In this regard, any discernible indicia placed on either the top panel of the mattress cover or the skirt portion thereof would ordinarily be visible through a sheet placed over the mattress cover, and would therefore detract from the aesthetic appearance of the sheet. This problem has made it difficult for manufacturers and other businesses to place ornamentation, particularly their trademarks, logos or other symbols, on the mattress covers.

There thus exists a need for a mattress cover which is simple in construction and inexpensive to produce, yet which is capable of accommodating the wide range of mattress thicknesses within a given size group with a proper fit which is neither too loose so as to look sloppy, or too tight so as to easily slip off of the mattress. There also exists a need for a mattress cover to which ornamentation, including indicia of source and other symbols, can be applied without interfering with the aesthetic appearance of a sheet placed over the mattress cover.

SUMMARY

Disclosed herein is a mattress cover comprising a top panel, a skirt extending downward from the periphery of the top panel, a securing belt attached to the skirt and a means of adjusting the length of the belt. The securing belt may be integrated into the skirt by various methods including but not limited to a pocket or sleeve looping around the center or bottom of the skirt, the securing belt may also be integrated by means of lacing in and out, an integrated channel, a plurality of belt loop structures or the like. The length of the belt may be adjusted by means of an adjusting buckle, a knot, a hook and grommet device, Velcro, button snaps or the like.

Accordingly, the primary object of the present invention is to provide a mattress cover that overcomes the disadvantages of the prior art.

These and other objects and advantages of the present invention will become apparent from a reading of the attached specification and appended claims. There has thus been outlined, rather broadly, the more important features of the invention in order that the detailed description thereof that follows may be better understood, and in order that the present contribution to the art may be better appreciated. There are features of the invention that will be described hereinafter and which will form the subject matter of the claims appended hereto.

DETAILED DESCRIPTION

Figure 1:
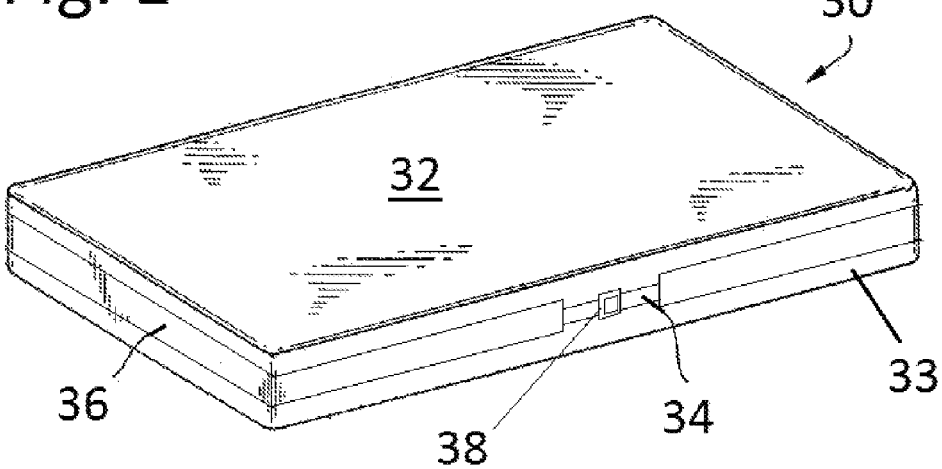
FIG. 1 is a perspective view of a mattress cover having a securing belt in accordance with the principles of the present invention.

Before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

Knitted elastic is a fabric made out of any flexible material woven together that will allow the fabric to stretch. The knitted elastic belt used within a fitted sheet, or mattress cover, will create a tight and snug fit around the mattress. Once incorporated into the fitted sheet or mattress cover, the belt will adjust and secure into place. The elastic belt will loop around and come through a middle section around the fitted sheet though a hole, the two ends of the belt will exit either on the shorter or longer side of the fitted sheet and connect or fasten with a buckle, magnet, Velcro® and/or any other device capable of adjusting and securing the length of the belt. This new securing system may be hidden within the fitted sheet, or mattress cover with access given through a middle section covered by a flap.

Depending on where the belt is placed, fabric may be sewn on top of the knitted elastic so the belt is not shown. This may be done for aesthetic purposes and several fabrics may be used. The secured fitted mattress cover may be sized for all sizes including, twin, full, queen and king size beds. It may similarly be used for pet beds, children's mattresses, sofa beds, murphy beds or other mattresses.

FIG. 1 shows a mattress cover in accordance with the principles of the present invention. Mattress cover 30 may have a top panel 32 and a skirt 33. Sleeve 36 may extend about the entire perimeter of the mattress cover 30 and may be incorporated into skirt 33. A securing belt 34 may extend through the entire length of the sleeve 36 and may be adjusted by means of buckle 38. The securing belt 34 maybe elastic or inelastic. Buckle 38 may be of any design that allows adjustment of the overall length of securing belt 34. It may be desirable to use a plurality of belt loops, rather than a sleeve 36 in order to hold securing belt 38 in place.

Figure 2:
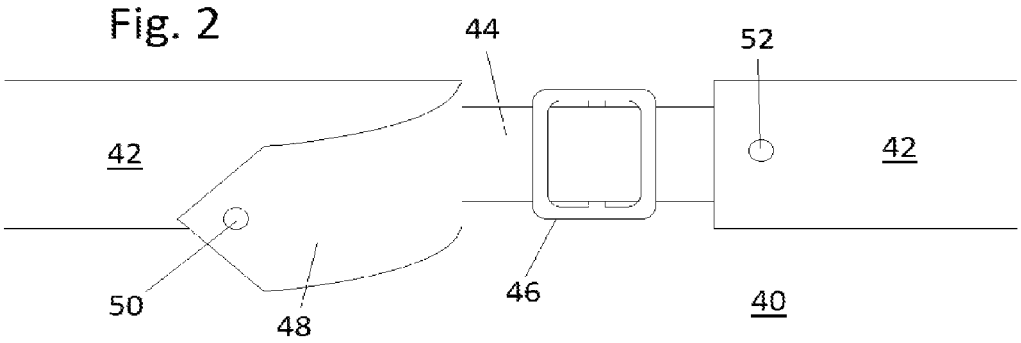
FIG. 2 is a perspective view of an alternative embodiment of a mattress cover having a securing belt in accordance with the principles of the present invention.

FIG. 2 is an enlarged view of a mattress cover skirt 40 very similar to the one shown in FIG. 1. FIG. 2 shows an alternative configuration in accordance with the principles of the invention. Skirt 40 may have a sleeve 42 that may extend its entire perimeter. Belt 44 may extend the length of the sleeve 42. The length of belt 44 may be adjusted by means of buckle 46. Flap 48 may be attached to sleeve 42. Flap 48 may have sufficient dimensions to completely cover the portion of the belt 44 that is not physically within sleeve 42. Snap 50 and 52 may be used to removably affix flap 48 over the exposed portion of the belt 44 and buckle 46.

Figure 3:
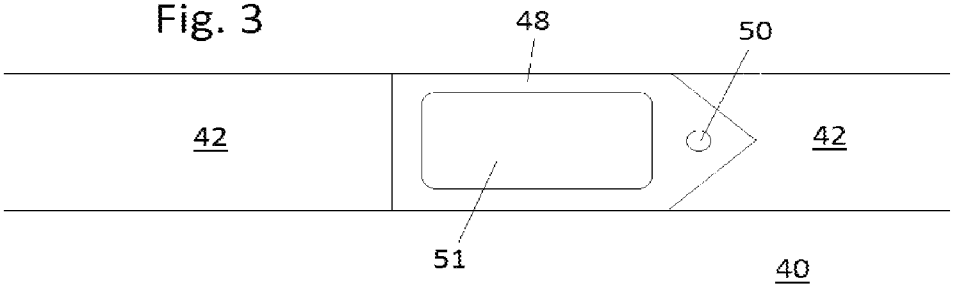
FIG. 3 is an enlarged view of an alternative embodiment of a mattress cover having a securing belt in accordance with the principles of the present invention.

FIG. 3 shows the mattress cover skirt 40 of FIG. 2 where flap 48 is snapped into place by means of snap 50 in order to cover belt 44. When the flap 48 is snapped into place, the belt 44 is no longer visible. Flap 48 may optionally include a placard 51 that may include one or more ornamental features, for example, a trademark, logo or other attractive design. The flap 48 used in conjunction with a mattress cover skirt and a sleeve may be used whether it is located on the long or short sides of a mattress cover skirt. The material of flap 48 may be the same or different from the material of sleeve 42. Placard 51 may be comprised of any material, including but not limited to, metal, plastic, carbon fiber, cotton, and vinyl. Optionally placard 51 may be removable such that alternative placards may be incorporated with the flap 48. FIGS. 2 and 3 show a snap 50 and 52 used to removably affix the flap 48 to cover the belt 44. Other suitable means of affixing the flap 48 to the sleeve 42 may be utilized. Other means include, but are not limited to, a button, a magnetic clasp, laces, Velcro® and the like.

Figure 4:
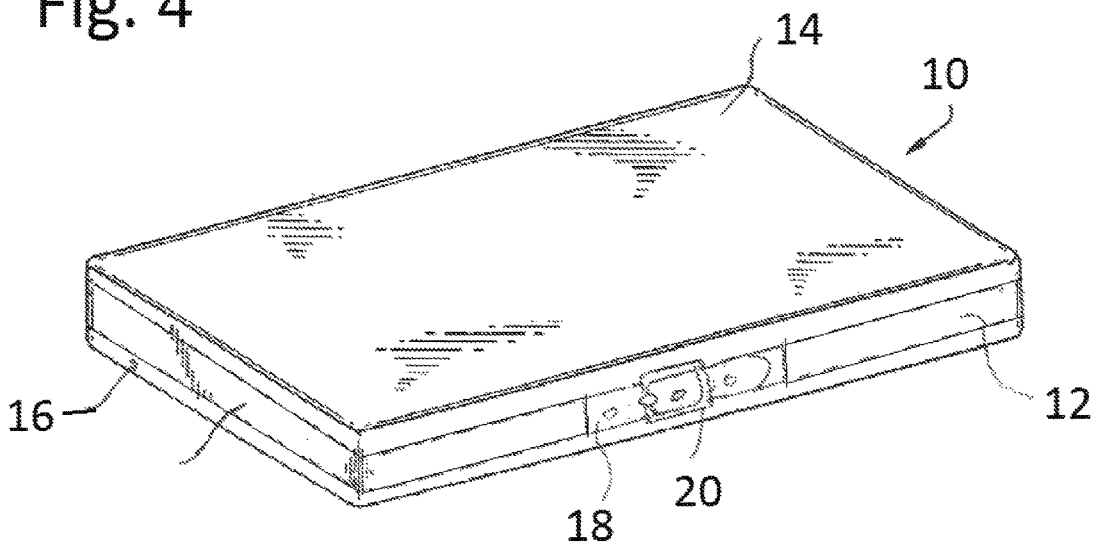
FIG. 4 is an enlarged view of an alternative embodiment of a mattress cover having a securing beltin accordance with the principles of the present invention.

FIG. 4 shows a mattress cover 10 having a top panel 14 and a skirt 16. A flat fabric sewn onto the skirt 16 of the mattress cover 10 may create a sleeve 12 that runs the entire perimeter of the mattress cover 10. The sleeve 12 and the flat piece of fabric creating it may be any design. A securing belt 18 may be incorporated into the skirt within the sleeve 12 in a manner similar to that of a string within an elastic band commonly used in sweat pants or men's bathing suits which may be adjusted by a buckle, such as a slider buckle, as commonly used on the straps of backpacks. Securing belt 18 may optionally be elastic, or inelastic. The skirt 16 may incorporate elastic material as well. Buckle 20 may be used to adjust the securing belt 18 to an appropriate length.

A knitted elastic belt may be interwoven through the skirt of a mattress cover having a top panel. The belt may loop in and out of the skirt of the mattress cover sheet through a plurality of slits. The ends of the knitted elastic belt may exit either on short or longer side of the fitted sheet. The two ends may of the belt may fasten onto a buckle having a placard similar to the placard of FIG. 4. A mattress cover may have a top panel and a skirt that overlays the sides of a mattress. A securing belt may be integrated throughout the entire skirt. The securing belt may be laced repeatedly between the inside and outside of the skirt by means of a plurality of slits for the entire length of skirt. A securing belt may include a buckle that may facilitate adjustment of the securing belt. By tightening the securing belt by means of the buckle, the mattress cover may firmly engage the entire mattress, thereby preventing the skirt from riding upwards and becoming disengaged with a mattress.

The buckle may also include a placard that may optionally be used to display a logo or other image. Optionally, the buckle itself may be used as an indicia of source or be ornamental in nature. The securing belt may be made of a variety of materials and may be elastic, comprised of lycra or other material, or may be inelastic and comprised of a fabric such as cotton, leather, or other material. The securing belt may be of a knitted elastic as described above, or may be comprised of any suitable material, elastic or inelastic and may be chosen in part based upon aesthetic reasons. The belt may be comprised of a wide range of materials, even metal or chain may be used. The skirt may include an elastic band upon its bottom. It may be preferable that the belt is positioned on the outside of the skirt at the corners. This may decrease the tendency of a mattress cover to ride upward while the mattress is in use. Optionally, a plurality of belt loop structures may be placed about the skirt to engage the belt with the skirt, as an alternative to the lacing in and out of the skirt.

Any buckle design may be used to adjust the length of a securing belt. Other methods of adjustment may also be suitable, such as, for example, replacing the securing belt with one of a suitable length, tying a knot instead of using a buckle, using a securing belt having one or more hooks for attaching to an eyelet or grommet in the skirt, the securing belt or the mattress itself.

Figure 5:
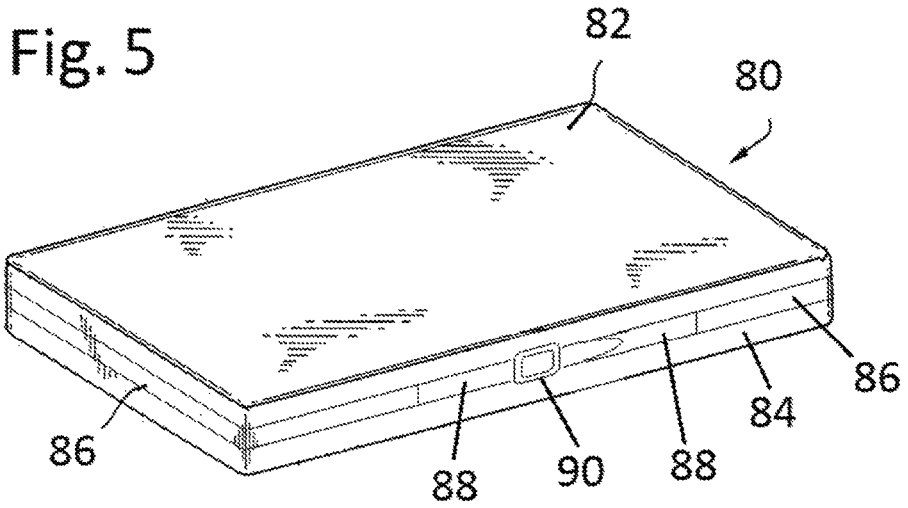
FIG. 5 is a perspective view of an alternative embodiment of a mattress cover having a securing belt in accordance with the principles of the present invention.

FIG. 5 shows a mattress cover 80 having a top panel 82 and a skirt 84. A belt 86 may be sewn onto the skirt 84. The belt 86 may be of any design. Alternatively, the belt 86 may be glued around the mattress cover's skirt 84. A portion 88 of the belt 86 may not be glued so that it may be adjusted. The length of the free portion 88 of the belt 86 may be adjusted by means of a buckle 90. In this embodiment, the free portion 88 of belt 86 and the buckle 90 are located on the long side of the mattress covers skirt 84. However, the free portion 88 and buckle 90 may optionally be located on the short side of the skirt 84.

Figure 6:
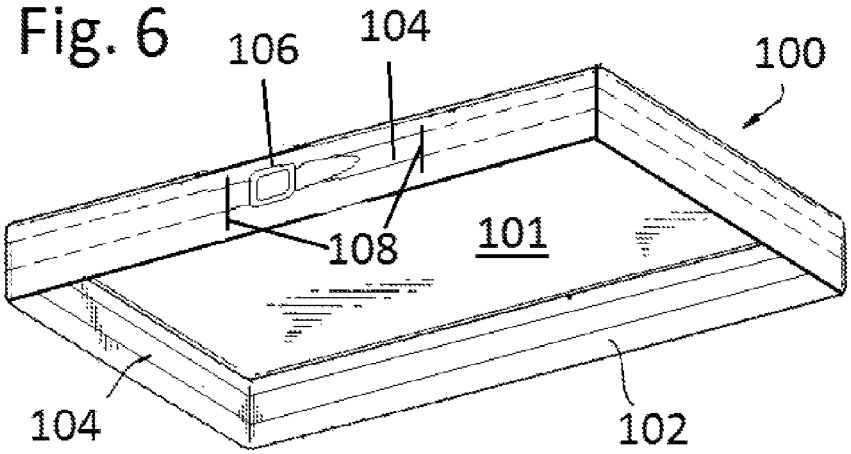
FIG. 6 is a perspective view of an alternative embodiment of a mattress cover having a securing belt in accordance with the principles of the present invention.

FIG. 6 shows an alternative embodiment of a mattress cover 100 and accordance with the principles of the invention. Mattress cover 100 may have a top panel 101 and a skirt 102. A belt 104 extends the length of the skirt 102 on the inside. The belt 104 may be stitched or glued or otherwise attached to the inside of skirt 102. Alternatively, the belt 104 may be attached to the inside of skirt 102 by a series of belt loops. Belt 104 exits to the outside of skirt 102 by means of slits 108. A buckle 106 on the exterior of skirt 102 allows for adjustment of the belt 104.

Figure 7:
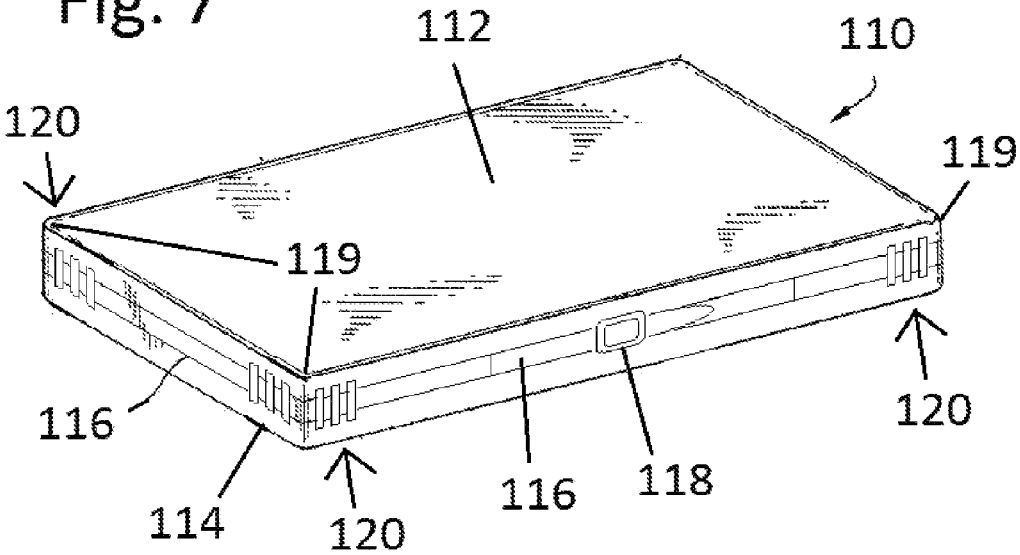
FIG. 7 is a perspective view of an alternative embodiment of a mattress cover having a securing belt in accordance with the principles of the present invention.

FIG. 7 shows another alternative embodiment of a mattress cover 110 in accordance with the principles of the invention. Mattress cover 110 may include a top panel 112 and a skirt 114. A belt 116 may extends along the entire length of the skirt 114 and be adjustable by means of buckle 118. As with the other embodiments, the buckle may be located anywhere along the skirt, but for simplicity has been shown on the long side of the skirt 114. All four corners 119 of the mattress cover 110 may include a plurality of belt loops 120. The belt loops 120 may hold the belt 116 in place about the corners 119. Along the sides of the skirt 114 between the corners 119. The belt 116 may be glued or sewn securely to the skirt 114 or may be free and not otherwise attached to the skirt 114. No one 16 may be elastic or inelastic.

Figure 8:
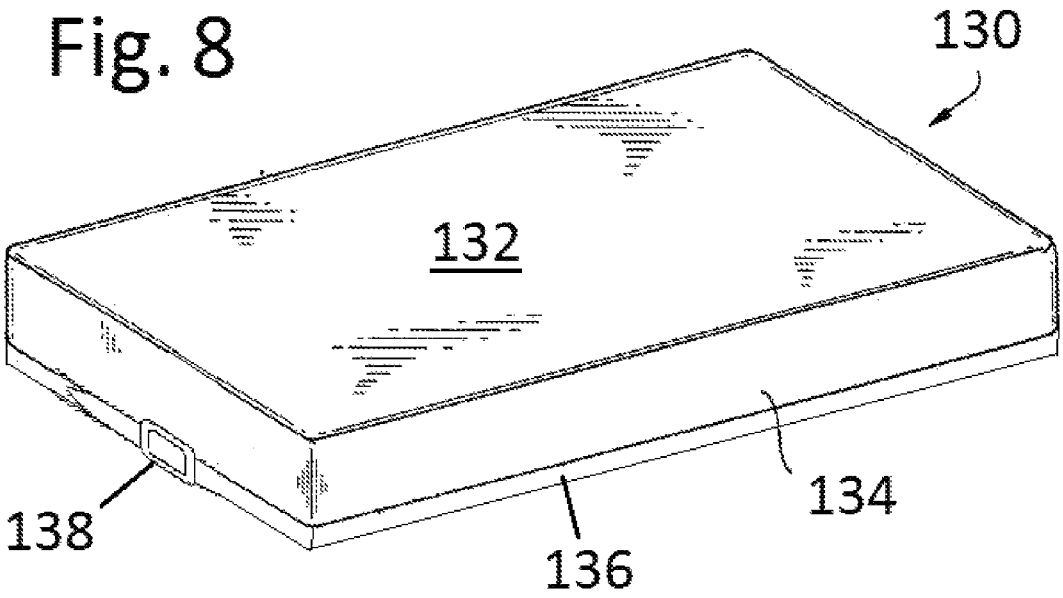
FIG. 8 is a perspective view of an alternative embodiment of a mattress cover having a securing belt in accordance with the principles of the present invention.

FIG. 8 shows an alternative embodiment of a mattress cover 130 in accordance with the principles of the invention. The mattress cover 130 may have a top panel 132 and a skirt 134. At the bottom of skirt 134 may be a belt 136 that may extend the entire length of the skirt 134. Belt 136 may have a buckle 138 or similar device for providing an adjustment of the length of the belt 136. The belt 136 may be glued and/or sewn onto the skirt 134. Alternatively, the bottom of skirt 132 may be provided with a plurality of belt loops that hold the belt into place. The securing belt may be integrated into the skirt by various methods including but not limited to a pocket or sleeve looping around the center or bottom of the skirt, the securing belt may also be integrated by means of lacing in and out, an integrated channel, a plurality of belt loop structures or the like.

Whereas, the present invention has been described in relation to the drawings attached hereto, it should be understood that other and further modifications, apart from those shown or suggested herein, may be made within the spirit and scope of this invention. Descriptions of the embodiments shown in the drawings should not be construed as limiting or defining the ordinary and plain meanings of the terms of the claims unless such is explicitly indicated.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

The invention claimed is:

1. A mattress cover comprising a top panel having a perimeter, a skirt extending downward from the perimeter of the top panel, a securing belt, a buckle and a sleeve that extends about the entire perimeter of the mattress cover and is integrated in the skirt, the securing belt extending through the sleeve and wherein the belt has a length that may be adjusted by the buckle;

further comprising a flap removably covering a portion of the belt that is not within the sleeve;

wherein the mattress cover has four corners and the belt is positioned on the outside of the skirt at each of the corners;

wherein the mattress cover is removably affixed to a mattress such that the skirt covers four sides of the mattress and the sleeve is located in the middle of the skirt such that it lies against the four sides of the mattress; and, wherein tightening the securing belt firmly engages the mattress cover with the four sides of the mattress such that the skirt does not ride upward and disengage the mattress.

2. The mattress cover of claim 1 further comprising a placard on the flap visible from one of the sides of the mattress.

3. The mattress cover of claim 1 wherein the buckle comprises a slider buckle.

4. The mattress cover of claim 1 wherein the buckle includes a placard visible from one of the sides of the mattress.

5. The mattress cover of claim 1 wherein a portion of the belt is glued to the skirt and a portion of the belt is not glued to the skirt.

* * * * *